US008413843B2

(12) United States Patent
Vardaro

(10) Patent No.: US 8,413,843 B2
(45) Date of Patent: Apr. 9, 2013

(54) HORIZONTAL SMALL PACKET DISPENSER

(76) Inventor: Antonio Vardaro, Montreal (CA)

( * ) Notice: Subject to any disclaimer, the term of this patent is extended or adjusted under 35 U.S.C. 154(b) by 321 days.

(21) Appl. No.: 12/839,912

(22) Filed: Jul. 20, 2010

(65) Prior Publication Data

US 2011/0015781 A1 Jan. 20, 2011

Related U.S. Application Data

(60) Provisional application No. 61/213,827, filed on Jul. 20, 2009, provisional application No. 61/213,828, filed on Jul. 20, 2009.

(51) Int. Cl.
*B65H 1/08* (2006.01)

(52) U.S. Cl. ..... 221/279; 221/125; 221/232; 221/280; 700/236; 700/242

(58) Field of Classification Search ..... 700/236, 700/242, 244, 240; 221/125, 132, 279, 280
See application file for complete search history.

(56) References Cited

U.S. PATENT DOCUMENTS

| | | | | |
|---|---|---|---|---|
| 4,336,892 | A * | 6/1982 | Cox et al. | 221/125 |
| 4,396,237 | A | 8/1983 | Henry | |
| 4,779,745 | A | 10/1988 | Prendergast et al. | |
| 4,865,222 | A | 9/1989 | Sullivan | |
| 5,263,596 | A * | 11/1993 | Williams | 221/153 |
| 5,553,738 | A * | 9/1996 | Roselli | 221/195 |
| 5,813,568 | A * | 9/1998 | Lowing | 221/6 |
| 6,318,591 | B1 * | 11/2001 | Martin | 221/279 |
| 6,330,958 | B1 * | 12/2001 | Ruskin et al. | 221/75 |
| 6,406,107 | B1 | 6/2002 | Franczak | |
| 6,684,126 | B2 * | 1/2004 | Omura et al. | 700/236 |
| 6,902,983 | B2 * | 6/2005 | Yoon | 438/396 |
| 7,077,287 | B2 | 7/2006 | Lanz | |
| 7,597,214 | B2 * | 10/2009 | Levasseur | 221/124 |
| 7,686,185 | B2 * | 3/2010 | Zychinski | 221/279 |
| 8,190,289 | B2 * | 5/2012 | Lockwood et al. | 700/236 |

FOREIGN PATENT DOCUMENTS

| | | | |
|---|---|---|---|
| EP | 0892374 | A1 | 1/1999 |
| WO | 03/096289 | A2 | 11/2003 |
| WO | 2007/066213 | A2 | 6/2007 |

* cited by examiner

*Primary Examiner* — Timothy Waggoner
(74) *Attorney, Agent, or Firm* — Ladas & Parry LLP

(57) ABSTRACT

A dispenser for packets comprises a plurality of horizontal rows comprising a plurality of side by said dispenser compartments. Each compartment defines a channel for receiving a horizontal stack of packets and comprises a front edge. A movement imparting assembly is mounted within each compartment and comprises a pusher member for engaging the horizontal stack of packets. The movement imparting assembly provides for the pusher member to selectively push forward the horizontal stack of packets so as to push at least one of the packets in the compartment off the edge thereof for retrieval. Sensor are mounted to the dispenser so as to detect dispensing of packets and to communicate this information to a controller.

17 Claims, 19 Drawing Sheets

HORIZONTAL SMALL PACKET DISPENSER

CROSS-REFERENCE TO RELATED APPLICATIONS

The present application claims priority on U.S. Provisional Patent Application No. 61/213,827 filed on Jul. 20, 2009 and on U.S. Provisional Patent Application No. 61/213,828 filed on Jul. 20, 2009 which are incorporated herein in their entirety.

TECHNICAL FIELD

The present disclosure relates to a dispenser. More specifically but not exclusively, the invention relates to a horizontal small packet dispenser. More particularly but not exclusively, the disclosure relates to a cigarette dispenser.

BACKGROUND

The art teaches a variety of small packet or cigarette dispensers.

Known cigarette dispensers include a cabinet with vertical columns for stacking packs of cigarettes. The user may pull out packs of cigarettes directly from bottom slanted cut outs. A camming piece pushes the lowermost package of the stack rearwardly thus the bottom package of each vertical stack projects to the rear allowing the package to be extracted via the cut out. The packages directly above the lowermost package do not follow the latter to the rear, since when the lowermost package is cammed to the rear; the second package from the bottom is restrained by a blocking bar. Once the lowermost package is removed then space is provide for the next package to take its place.

Some dispensers also provide for displaying advertisements. For example, the art teaches purchase gravity feed package product dispensers with a bottom opening to manually pull out a package. The dispensers include panels which are replaceable in order to display a variety of advertisements. The art also teaches a dispenser having bottom feed outlets with packs that are vertically stacked to be manually removed from openings. This dispenser includes a removable display sleeve for advertisements.

OBJECTS

An object of the present disclosure is to provide a horizontal small packet dispenser.

An object of the present disclosure is to provide an automated small packet dispenser.

An object of the present disclosure is to provide a cigarette dispenser.

An object of the present disclosure is to provide a horizontal dispenser and cabinet assembly.

An object of the present disclosure is to provide a system for monitoring the inventory of packets that are dispensed at a plurality of locations

SUMMARY OF THE EMBODIMENTS

In accordance with an aspect of the disclosure, there is provided a dispenser for packets comprising:

at least one compartment defining a channel for receiving a horizontal stack of packets, the compartment comprising a front edge; and a movement imparting assembly mounted within the compartment and comprising a pusher member for engaging the horizontal stack of packets, wherein the movement imparting assembly provides for the pusher member to selectively push forward the horizontal stack of packets so as to push at least one of the packets in the compartment off the edge thereof for retrieval.

In an embodiment, there is provided a plurality of side by side compartments, each compartment defining a channel receiving a respective horizontal stack of packets, each compartment comprising a front edge, a movement imparting assembly respectively mounted within each compartment and respectively comprising a pusher member for engaging the respective horizontal stack of packets.

In an embodiment, a door is positioned in front of the compartment and forwardly spaced from the front edge. In an embodiment, the packet is provided to fall between the door and the front edge when pushed forwardly.

In an embodiment, the movement imparting assembly comprises a movement imparting element positioned beneath the pusher member for providing the pusher member to move forward within the channel. In an embodiment, the movement imparting element is actuated by an actuator. In an embodiment, the movement imparting element is provided to rotate. In an embodiment, the actuator comprises a helicoidal member provided to rotate. In an embodiment, the pusher member comprises a base having a pin for being engaged by the movement imparting element. In an embodiment, the dispenser further comprises a support for the horizontal stack of packets, this support comprising a slot for the movement imparting element to protrude therethrough so as to engage the pusher member.

In an embodiment, the pusher member comprises a backing support for the horizontal stack of packets. In an embodiment, the pusher member comprises a base slidably mounted to guide members so as to forwardly slide thereon during pushing thereof.

In an embodiment, the compartment is removably mountable to a frame. In an embodiment, the compartment comprises a rear wall with a connector to be connected to a corresponding connector mounted to said frame. In an embodiment, the channel is rearwardly slanted relative to the front edge.

In an embodiment, the dispenser further comprises a sensor for detecting that at least one packet has fallen off the front edge. In an embodiment, sensor is in communication with a controller. In an embodiment, the sensor is in communication with the movement imparting assembly for signalling the movement imparting assembly to cease pushing the horizontal stack of packets forward when the at least one packet falls off the front edge.

In an embodiment, the dispenser further comprises a sensor assembly for detecting when the last packet of the horizontal stack of packets has been pushed off the front edge. In an embodiment, the pusher member comprises an emitter, the compartment comprising a sensor mounted near the front edge, wherein when the emitter mates with the sensor thereby providing a signal. In an embodiment, the signal is communicated to a controller. In an embodiment, the signal is communicated to the movement imparting device for deactivation thereof.

In accordance with an aspect of the disclosure, there is provided a dispenser assembly for packets comprising:

a plurality of vertically stacked dispenser rows comprising a plurality of side by side compartments, each compartment defining a respective channel for receiving a horizontal stack of packets and comprising a front edge; and a respective movement imparting assembly mounted within each compartment and comprising a pusher member for engaging the horizontal stack of packets within said channel, wherein each movement imparting assembly provides for the pusher member to selectively push forward a respective horizontal stack of packets so as to push at least one of the packets of a given stack in a given compartment off the edge thereof for retrieval.

In accordance with an aspect of the present disclosure, there is provided a dispenser assembly for packets comprising:

a frame;

a plurality of vertically stacked dispenser rows mounted to the frame, each row comprising at least one compartment defining a respective channel for receiving a horizontal stack of packets, the compartment comprising a front edge and a movement imparting assembly providing for selectively pushing forward a respective horizontal stack of packets thereby pushing at least one of the packets of the compartment off the edge thereof for retrieval;

wherein the frame and the compartment comprise mutually engaging connectors for releasably connecting the dispenser row to the frame.

In an embodiment, a respective door is mounted to the frame in front of each dispenser row and forwardly spaced relative to the front edge thereof.

In accordance with an aspect of the disclosure, there is provided a system for monitoring the inventory of packets that are dispensed at a plurality of locations comprising:

a plurality of dispensers containing an initial known number of packets, each dispenser being located at a respective location;

a plurality of sensors, each sensor mounted to a respective dispenser for detecting dispensing of a packet;

a plurality of local controllers, each local controller in communication with a respective sensor so as to be notified when a packet is dispensed by a s dispenser at a given location;

a remote controller having information regarding the initial known number of packets in each dispenser and being linked to each local controller so as to be notified when a packet of a given dispenser at a given location is dispensed.

In accordance with an aspect of the present disclosure there is provided horizontal dispenser assembly comprising: a plurality of stacked horizontal dispenser rows, each row comprising at least one compartment for receiving small packets therein, each compartment comprising a front edge; and a pushing assembly mounted to each row for selectively pushing forward packets so as to push at least one of the packets in the compartment off the edge thereof for retrieval.

In accordance with an aspect of the present disclosure, there is provided a horizontal dispenser row comprising: a plurality of side by side compartments each compartment comprising a front edge; and a pushing assembly mounted to each compartment for selectively pushing forward packets so as to push at least one of the packets in the compartment off the edge thereof for retrieval.

In accordance with an aspect of the present disclosure, there is provided a horizontal dispenser assembly comprising a plurality of stacked horizontal dispenser rows is provided. Each row comprises at least one compartment for receiving small packets therein. Each compartment comprises a front edge. A pushing assembly mounted to each row provides for selectively pushing forward packets so as to push at least one of the packets in the compartment off the edge thereof for retrieval. A horizontal dispenser row comprising a plurality of side by side compartments is provided. Each compartment comprises a front edge. A pushing assembly mounted to each compartment provides for selectively pushing forward packets so as to push at least one of the packets in the compartment off the edge thereof for retrieval.

Other objects, advantages and features of the present invention will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, where like reference numerals denote like elements throughout and in where:

FIG. 8A is perspective view of a horizontal dispenser row in accordance with a non-limiting illustrative embodiment of;

DETAILED DESCRIPTION OF ILLUSTRATIVE EMBODIMENTS

Generally stated, in a non-exclusive embodiment thereof, the present invention provides a horizontal dispenser assembly made of stacked dispenser rows. Each rows has a compartment for receiving small packets therein. A pushing element pushes the small packet out of the compartment. A front cover provides a space for the packets to fall forwardly into a receptacle to be retrieved.

With reference to the appended drawings, illustrative embodiments of the present invention will be described herein so as to exemplify the invention and in no way limit the scope thereof.

FIGS. 1-4 show a small packet dispenser 10 comprising a plurality of stacked horizontal row dispensers 12, a base element 14, and a top cover 16.

Figure 4:
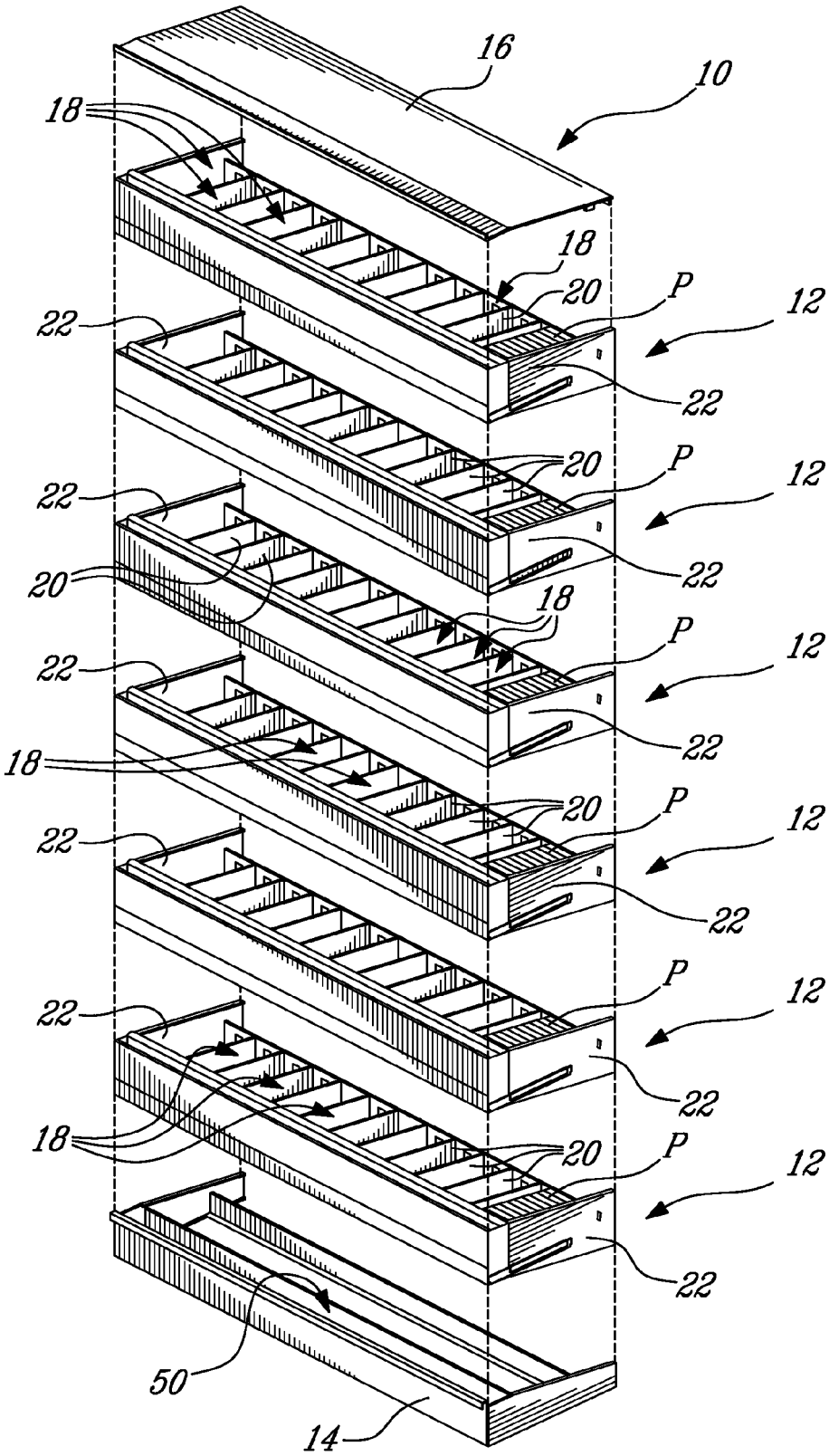
FIG. 4 is an exploded perspective view of the horizontal dispenser assembly of FIG. 1.
Figure 5:
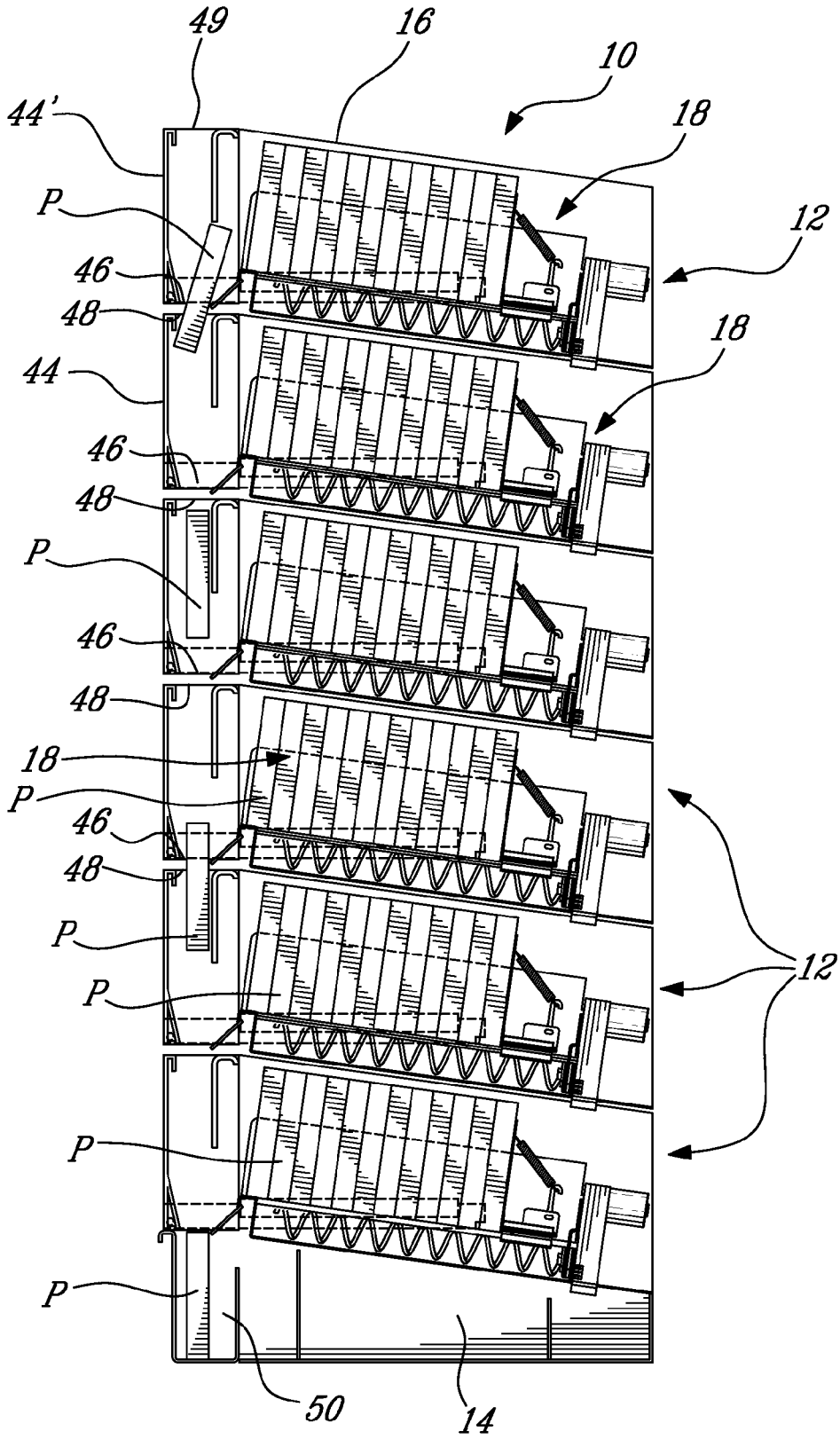
FIG. 5 is a lateral sectional view of the horizontal dispenser assembly of FIG. 1.

FIG. 4 shows that each horizontal row dispenser 12 is separated into a plurality of adjacent compartments 18, by separator walls 20. The sides of each dispenser 12 are capped by side panels 22. FIGS. 4 and 5 show that a plurality of small packets P such as cigarettes, for example, is positioned within the channels or areas 19 (see FIG. 7).

Figure 7:
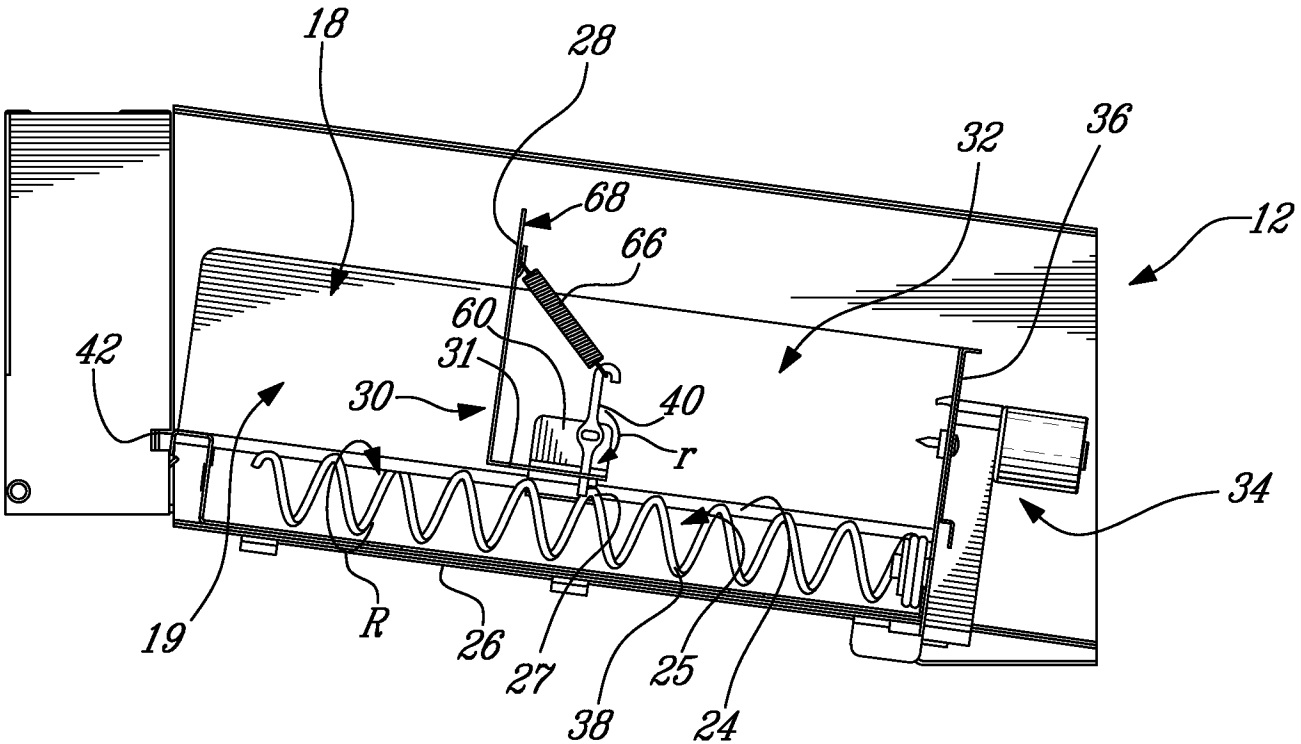
FIG. 7 is a lateral sectional view of a horizontal dispenser row in accordance with a non-limiting illustrative embodiment.
Figure 8A:
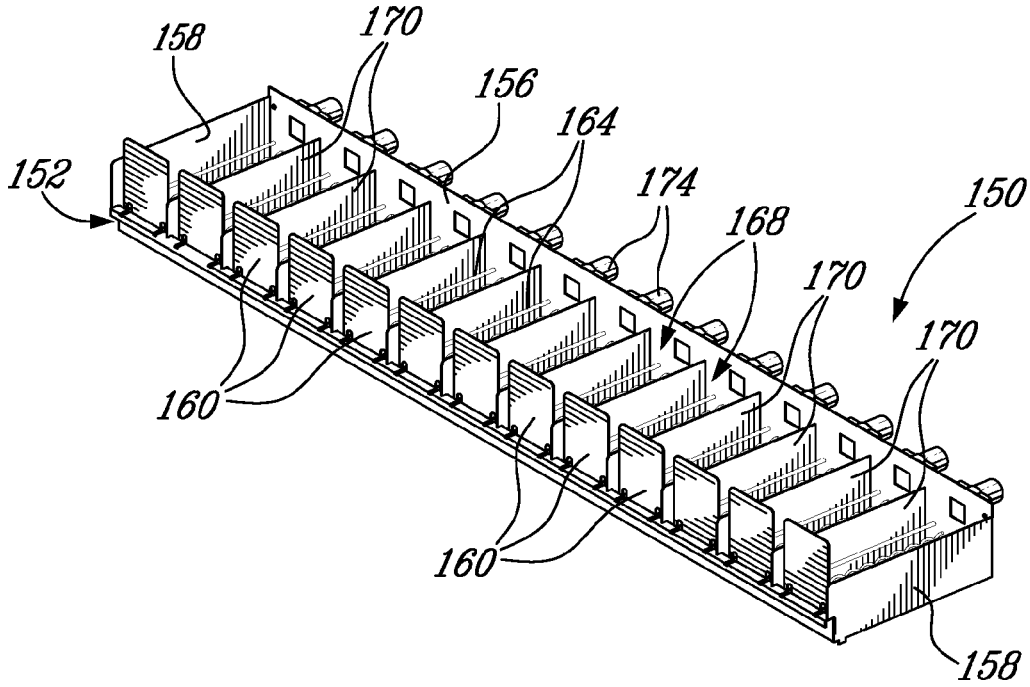
Figure 8B:
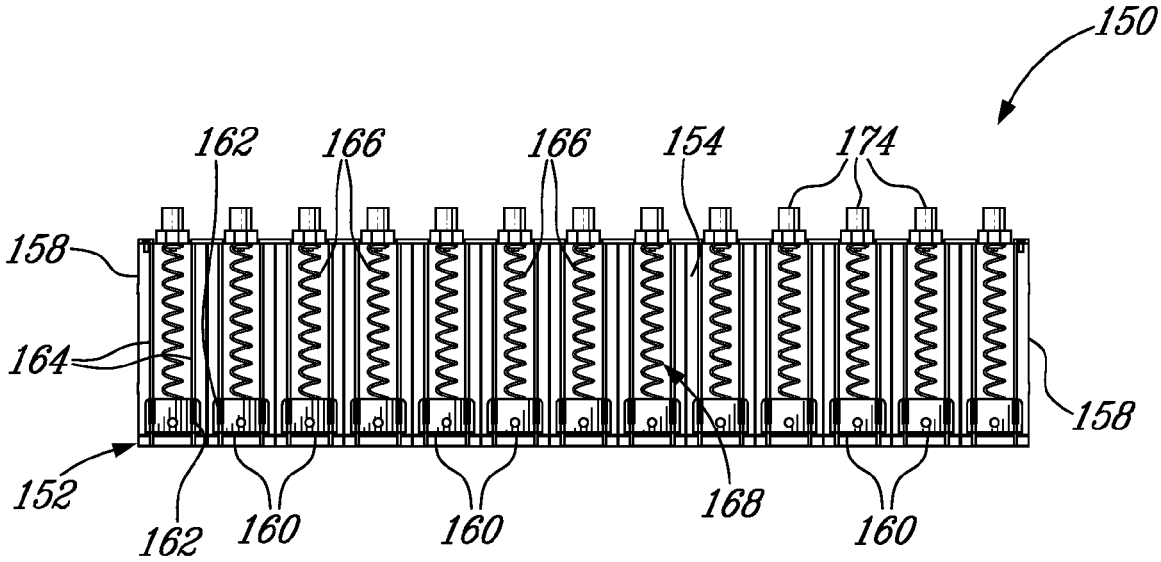
FIG. 8B is top plan view of the horizontal dispenser row of FIG. 8A.
Figure 9:
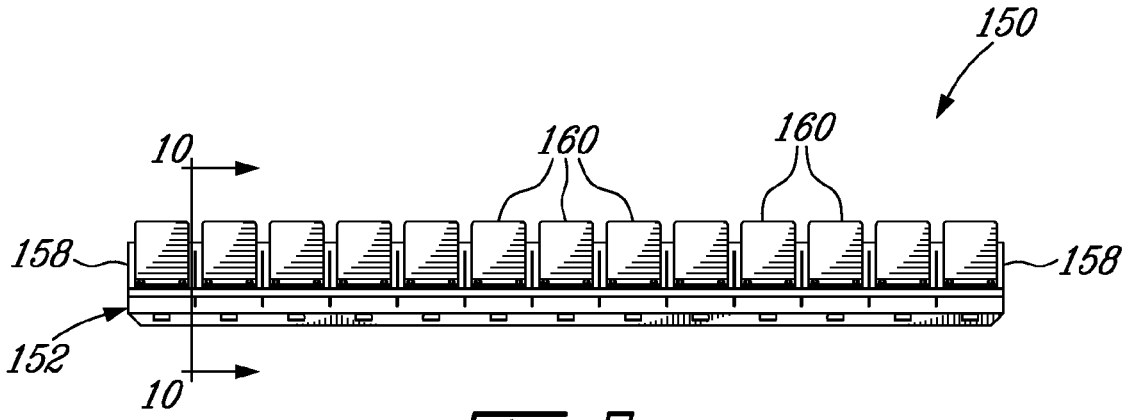
FIG. 9 is front elevational view of the horizontal dispenser row of FIG. 8A.
Figure 10:
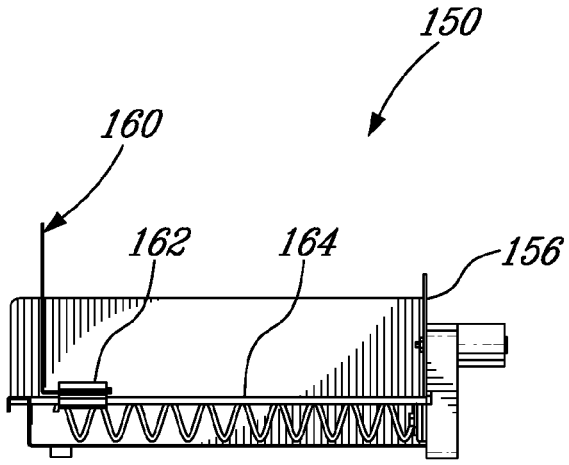
FIG. 10 is a lateral sectional view of the horizontal dispenser row of FIG. 8A.
Figure 11:
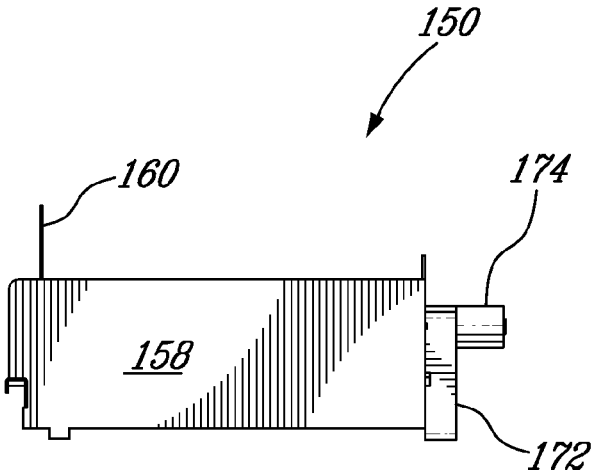
FIG. 11 is a side elevational view of the horizontal dispenser row of FIG. 8A.
Figure 12:
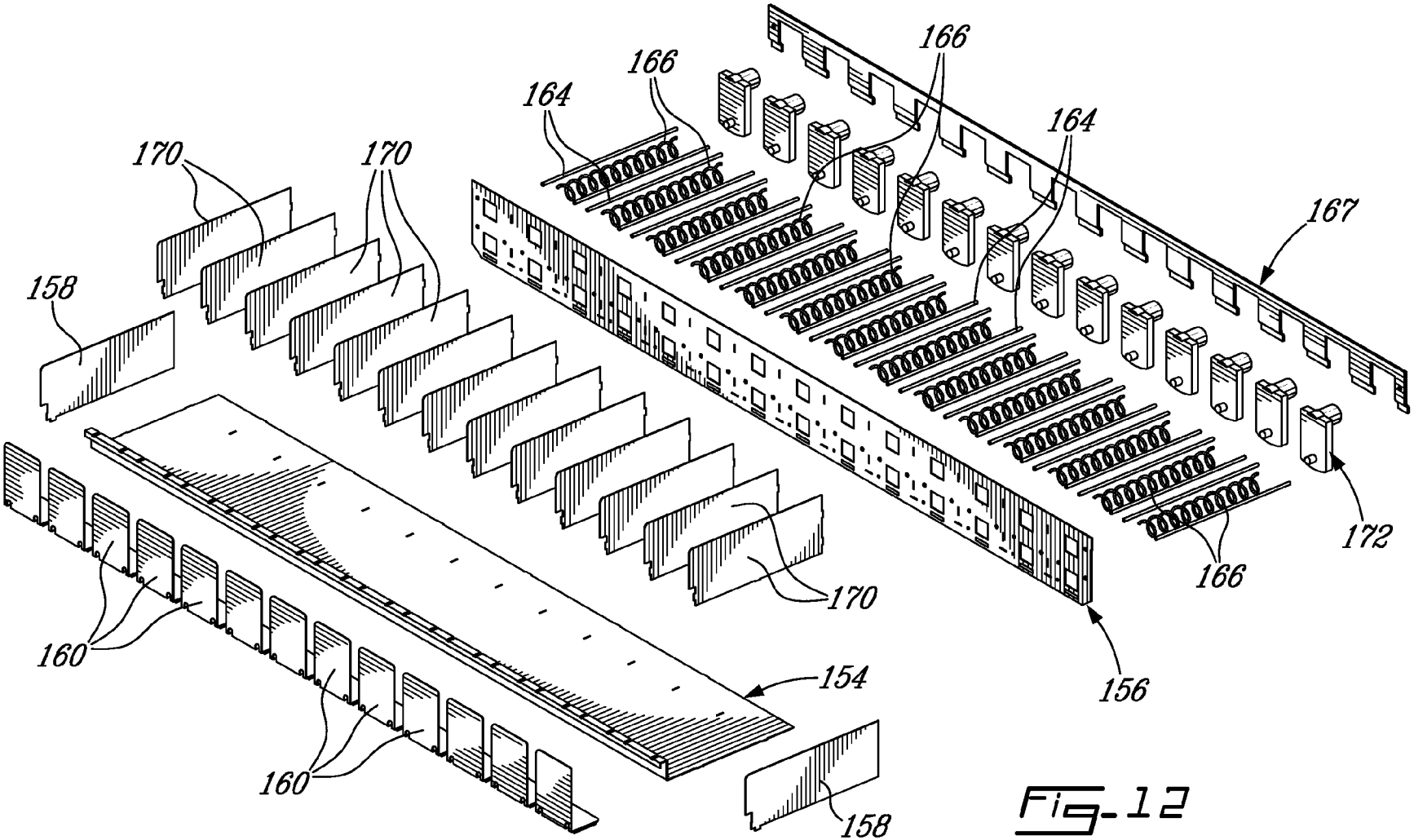
FIG. 12 is an exploded perspective view of the horizontal dispenser row of FIG. 8A.

With respect to FIG. 7, the packets P are positioned on guide elements 24. The inclination of the base element 14 and the configuration of each dispenser bottom wall or floor 26 (FIG. 7) provides a slant which causes the packets P to rest on a back supporting element 28 as they stand on the guide elements 24 which act as supports.

The back support element 28 is part of a pushing member 30 which in includes a base 31 that is slidably mounted to the guide members 24 and that forms part of a movement imparting assembly or a pusher assembly 32.

The pusher assembly 32 includes an actuator 34, in the form of a motor, mounted to the backing wail 36 of the horizontal row dispenser 12 to for actuating a movement imparting element 38 in the form of a helicoidal member. The helicoidal member 38 turns about a central axis and abut a pin 40 mounted to the base 31 that causing the pushing member 30 to slide along the guide members 24 thereby pushing the packets P off the edge 42 of the guide members 24.

Each dispenser 12 includes an elongated door 44 mounted on the front side of the dispenser 12.

Figure 1:
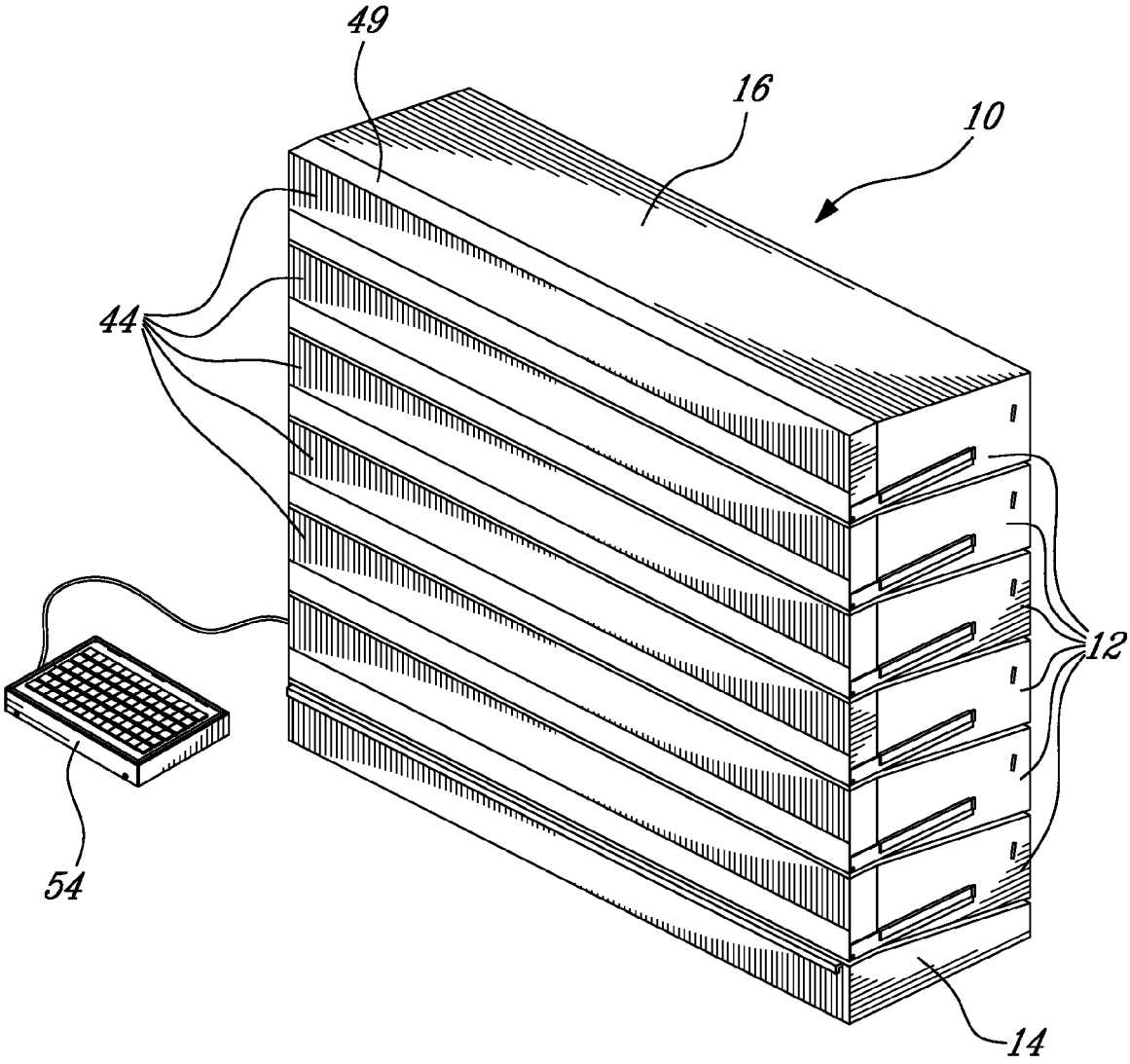
FIG. 1 is a perspective view of a horizontal dispenser assembly in accordance with a non-limiting illustrative embodiment.
Figure 2:
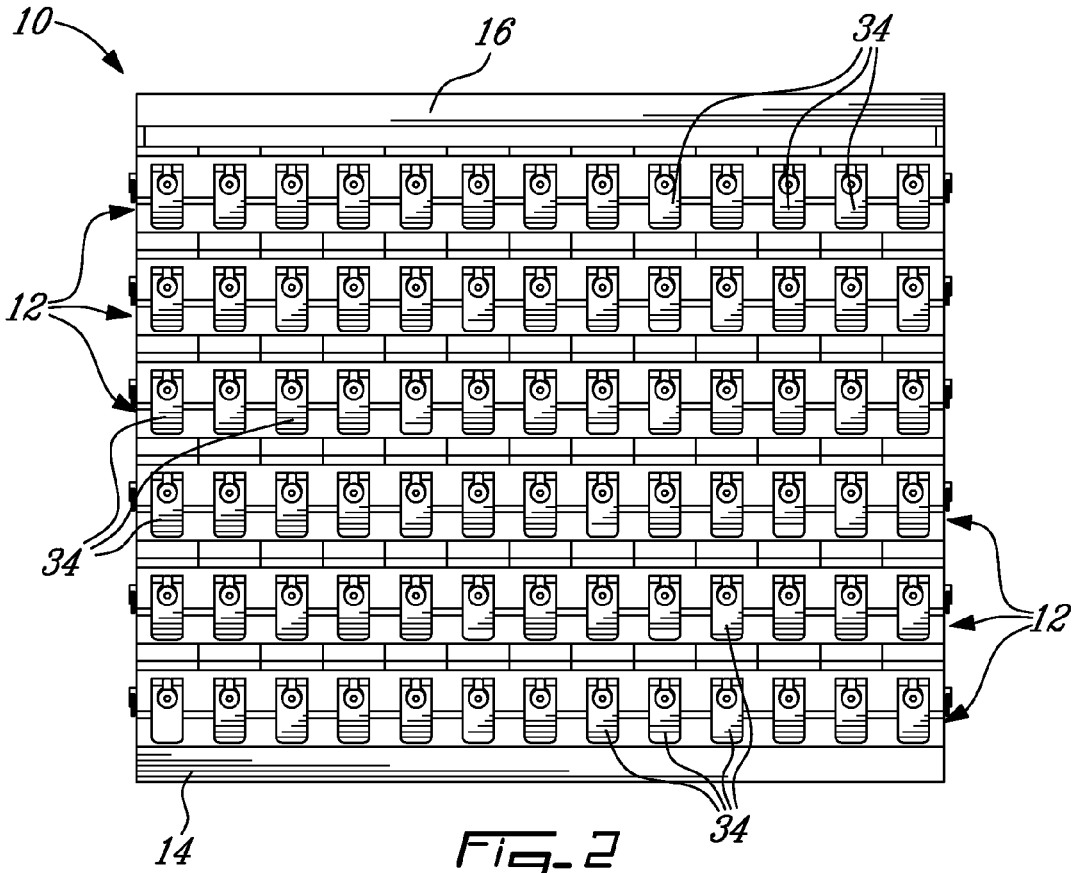
FIG. 2 is rear view of the horizontal dispenser assembly of FIG. 1.
Figure 3:
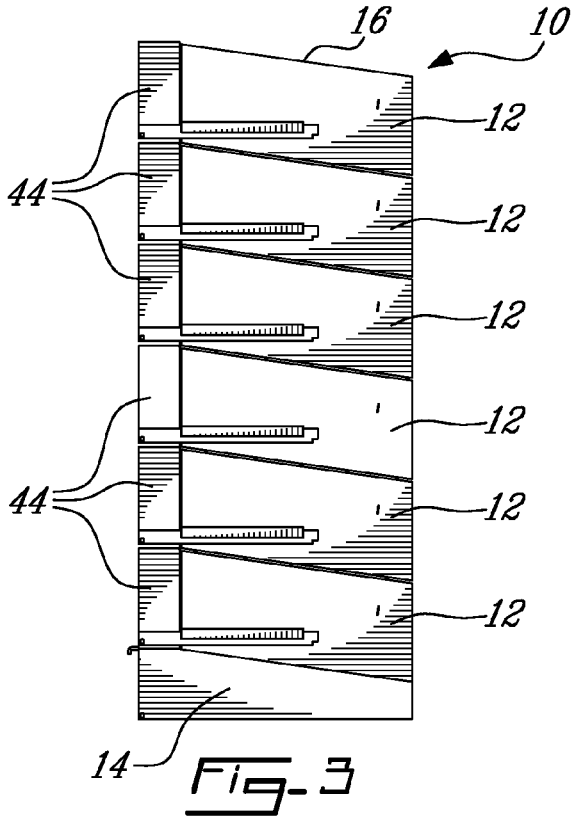
FIG. 3 is side view of the horizontal dispenser assembly of FIG. 1.

With respect to FIG. 5, the elongated door 44 includes a bottom opening 46 as well as a top opening 48 except for the uppermost door 44' which includes a top cover 49 (see also FIG. 1). Hence the stacked doors 44 provide via their aligned openings 46 and 44 a pathway towards a bottom receptacle 50 defined by a base member 14.

In this way, as small packets are moved forward and fall off the edges 42 of the guide elements 24 at the front side 42 of a dispenser 12, the small packet will fall through the pathway defined by openings 46 and 48 until they reach receptacle 50 which includes a door 52 (see FIG. 6B) for retrieval of internal contents.

FIG. 1 shows a control panel 54 that allows for controlling the plurality of actuators 34. Hence, each channel 19 may have a given type of small packet, the position of which is known to the control panel 54 and hence the user can select a given packet P on a given dispenser row 12 within a given area 18. Furthermore, a sensor can keep count of the packets P in each area 18 of each dispenser row and in this way notify the user that a given compartment 18 on a given horizontal dispenser row 12 is empty.

Figure 6A:
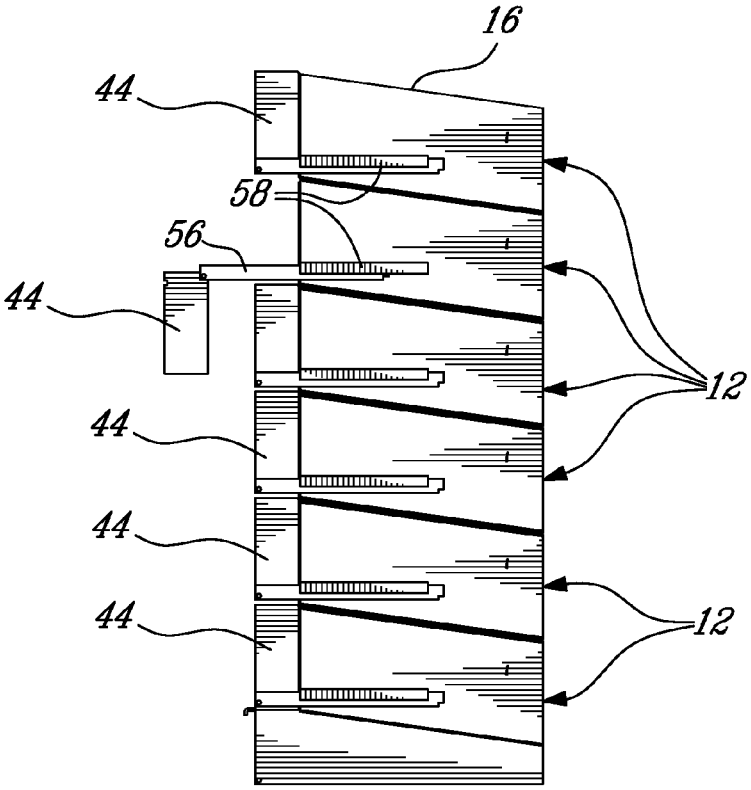
FIGS. 6A and 6B side elevational views similar to FIG. 2.
Figure 6B:
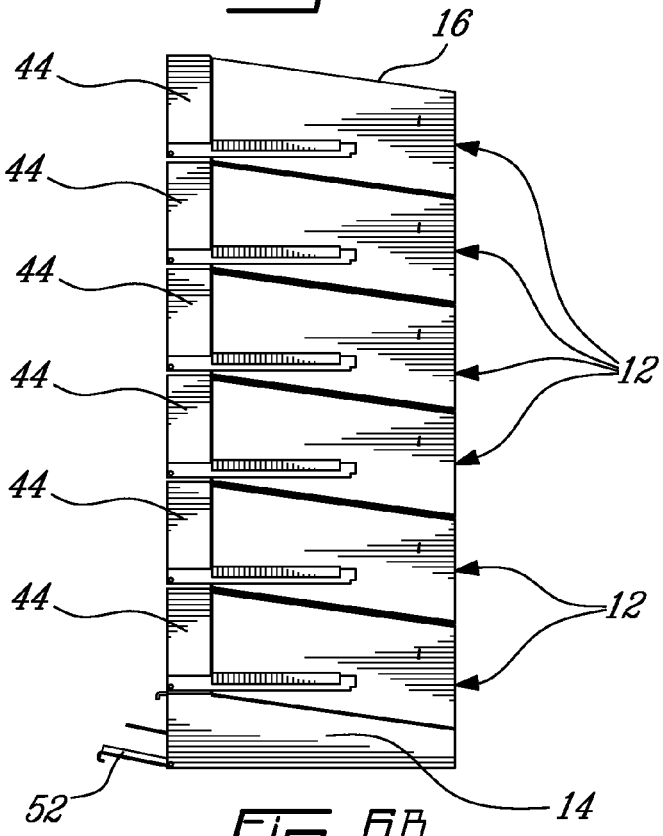

Turning to FIG. 6A, when filling a given compartment 18 on a dispenser row 12, the user will move the door forwardly via guides 56 which are slidably mounted to in channels 58 defined along the side panels 22.

With respect to FIG. 7, the pin element 40 is pivotally mounted to a support 60 upstanding from the base 31. The bottom end 62 of the pin element 40 protrudes from a slot (not shown) within the base 31 which engages the helicoidal element 38. The top end 64 of the pin element is in the form of a hook and engages a spring 66 mounted to the rear side 68 of the backing support 28.

When the user fills a compartment 18 with small packets, the pushing member 30 can be pushed inwardly. The helicoidal member 24 turns as shown by arrow R abutting the pin element 40 and causing it to pivot in the direction shown by arrow r as it is engaged by a cam portion 25 to then return to its original position by the force of the spring 66 in a groove 27 between two cam portions 25.

FIGS. 8A to 12 show a vertical dispenser row 150 in accordance with another illustrative embodiment of the present invention.

The vertical dispenser row 150 includes a housing 152 including a floor plate 154, a backing plate 156 and side panels 158.

A plurality of pushing elements 160, formed of bent metal pieces, engage the packets; the pushing elements 160 respectively include sleeves 162 for receiving guiding rods 164 secured to the backing plate 156. Movement imparting elements in the form of helicoidal members 166 engage a bottom end of the pushing elements to thereby displace each pushing element 160 along a respective pathway 168 as it is guided along guiding rods 164. The pathways 168 are separated by separator walls 170 which are mounted to the floor plate 154 and the backing plate 156. An auxiliary backing element 167 is mounted onto the backing plate 156 to retain the rods 164.

Actuators in form of motors 172 are mounted on the rear side of the backing plate 156 and are connected to the helicoidal members 166 for actuation thereof. As the helicoidal member 166 it advances a given pusher element 160 along a respective pathway 168.

FIGS. 13 to 24 show a horizontal dispenser in accordance with another non-restrictive illustrative embodiment.

Figure 13:
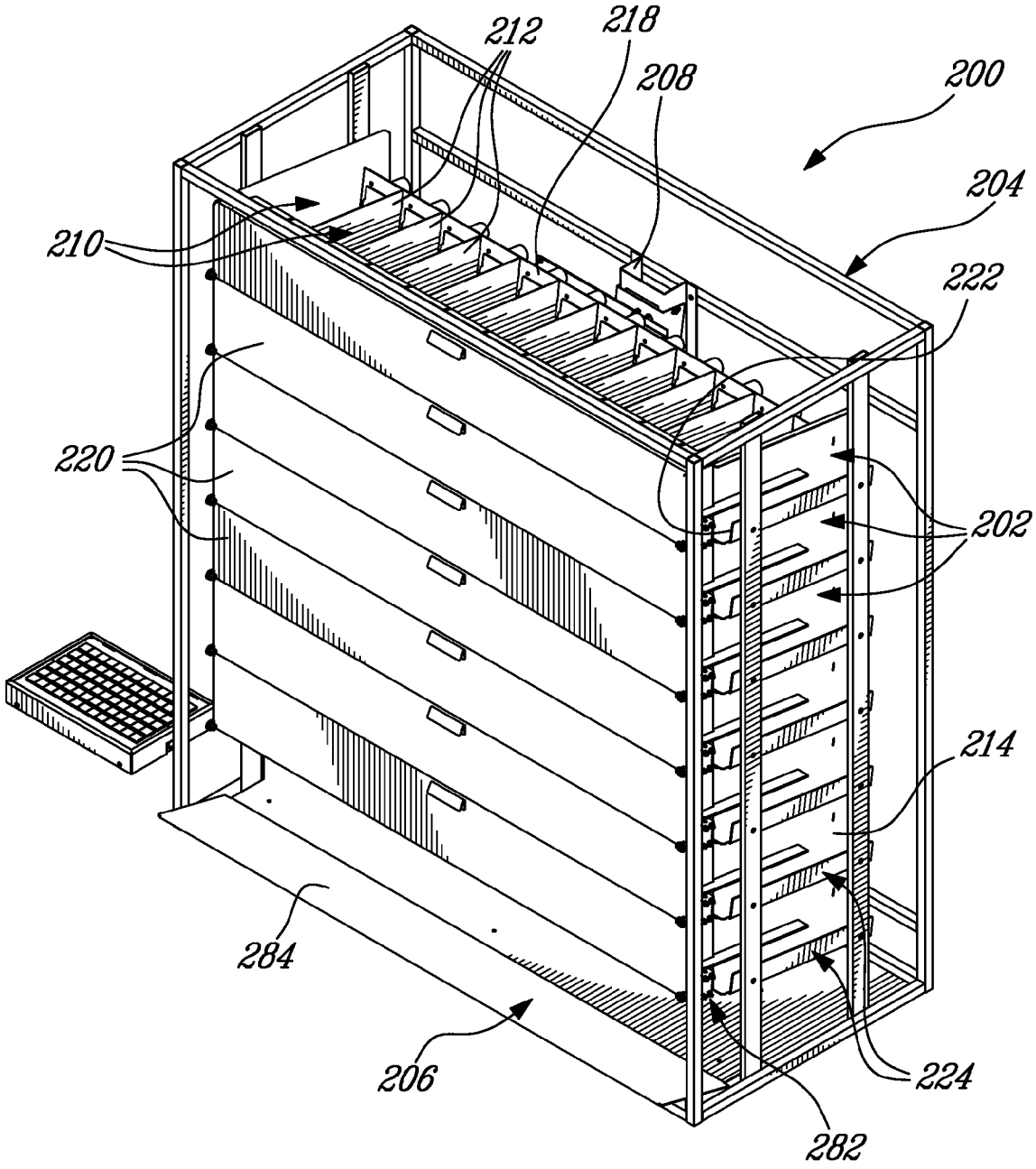
FIG. 13 is a perspective view of a dispenser assembly in accordance with another illustrative embodiment.
Figure 19:
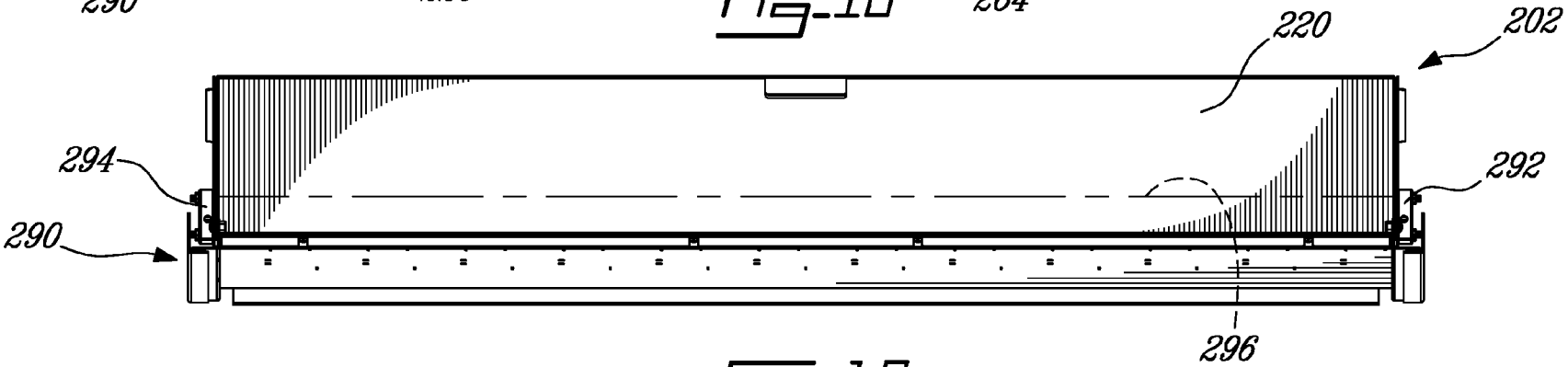
FIG. 19 is front elevational view a dispenser row of the dispenser assembly of FIG. 13.
Figure 20:
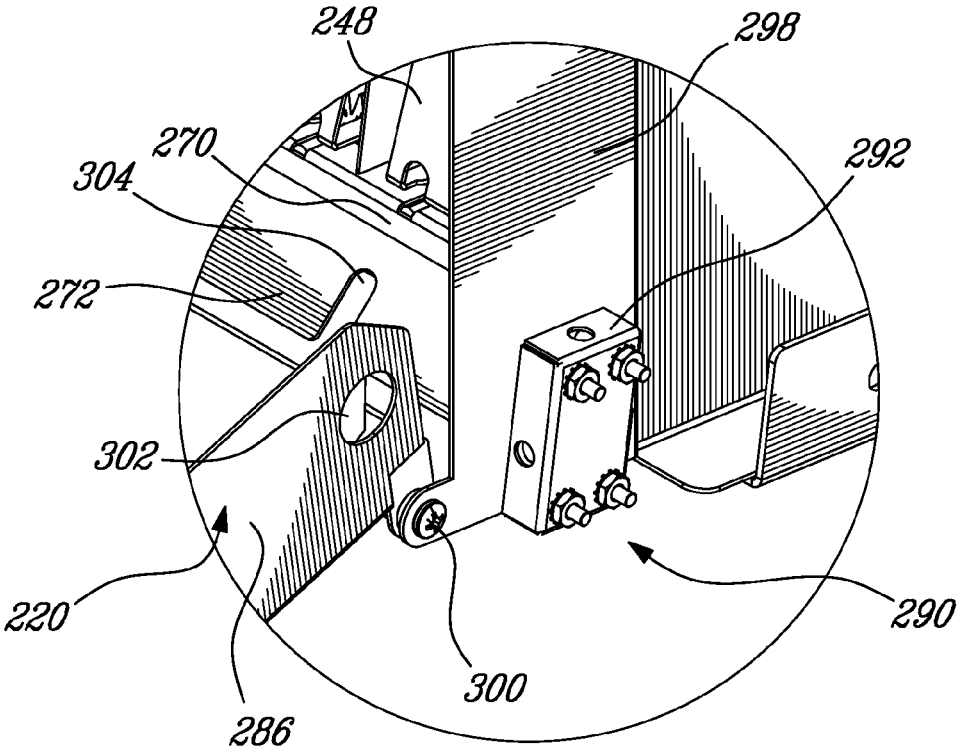
FIG. 20 is a perspective close up view of an open door of the dispenser assembly of FIG. 13.

FIG. 13 shows a dispenser assembly 200 comprising a plurality of stacked horizontal rows of dispensers 202 mounted to a frame structure 204 having a base 206 and a back panel 208. FIGS. 13 and 19 show that each dispenser 202 is separated into a plurality of adjacent compartments 210, by separator walls 212 defining channels 211 (see FIG. 22) for receiving horizontal stacks of packets. The sides of each dispenser 202 are capped by side panels 214 mounted to a common floor 216 (see FIG. 14) and a common backing wall 218 (see FIG. 13). Each dispenser 12 is obscured by elongated front door 220 mounted at the respective front side thereof.

Figure 16:
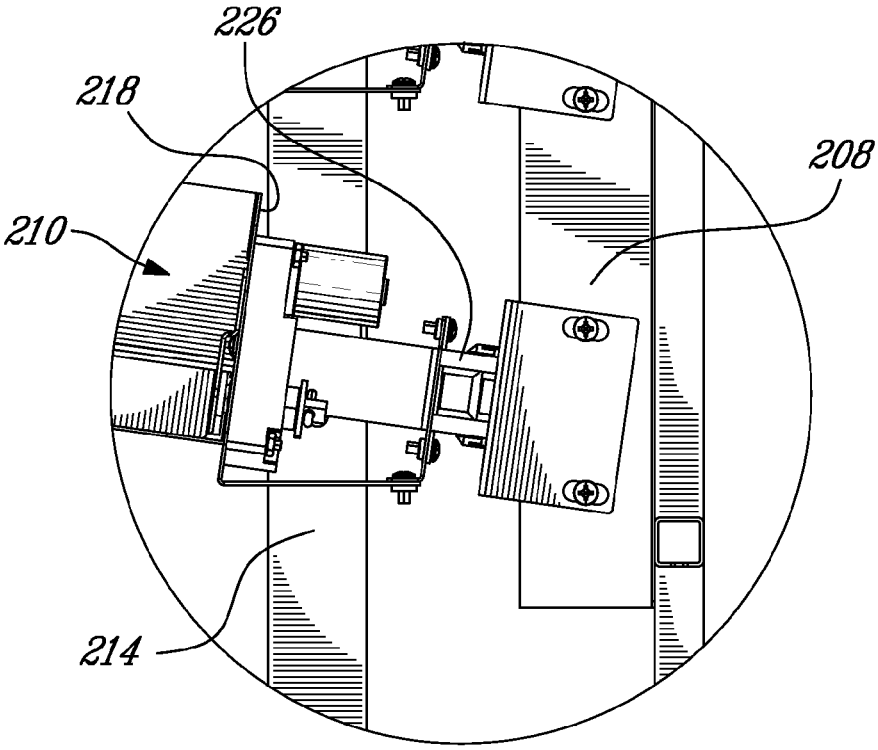
FIG. 16 is an enlarged view of portion 16-16 of FIG. 14.
Figure 17:
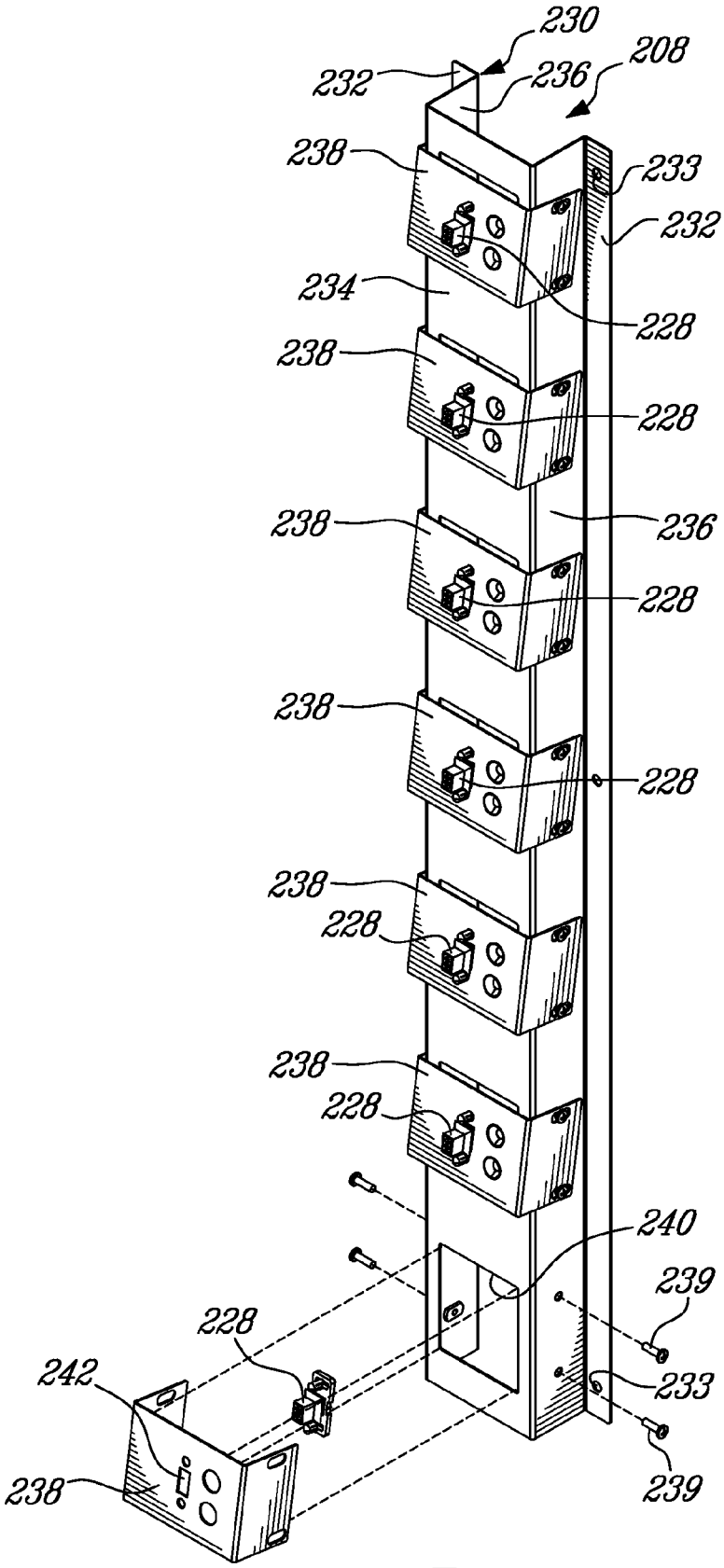
FIG. 17 is a perspective view of the back panel for connecting dispenser rows of the dispenser assembly of FIG. 13.

Each dispenser 12 is positioned within a respective open row 222 defined by receiving shelves 224 of the frame 214. The common backing wall 218 is removably connected to the backing panel 208. As shown in FIGS. 16 and 17, the backing wall 218 comprises a connector 226 for mating with a corresponding connector 229 provided by the backing panel 216.

Figure 14:
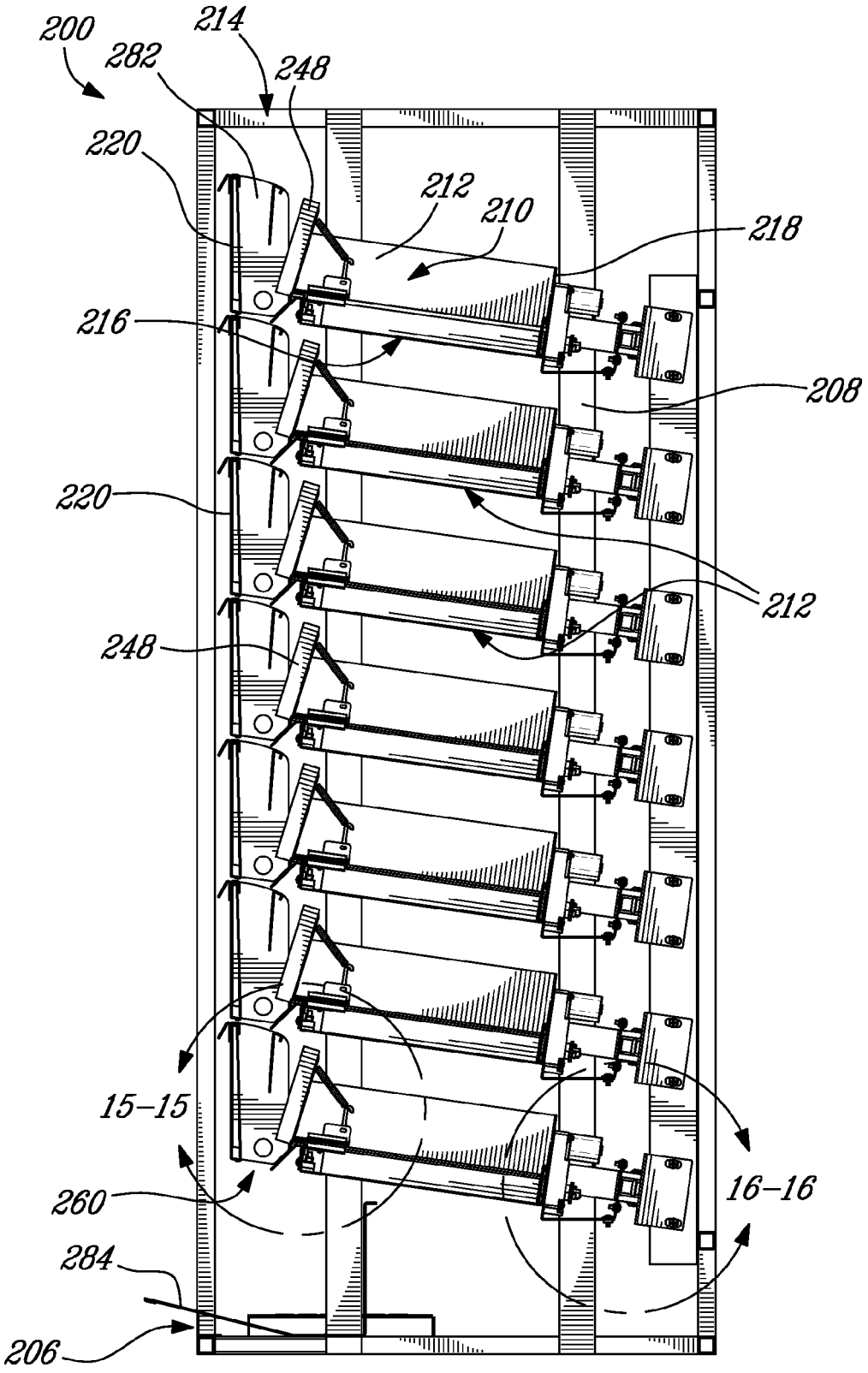
FIG. 14 is a lateral sectional view of the dispenser assembly of FIG. 13.

With particular reference to FIG. 17, the backing panel 208 comprises a vertical main body 230 having a pair of side strips 232 with holes 233 for being connected to the frame 204. The main body 230 includes a series of vertically disposed connectors 228 each providing for releasably connecting a dispenser 202 thereto. The main body 230 includes a median portion 234 flanked by side flanges 236 for mounting a bracket 238 via fasteners 239 at an inclined position relative to the plane of the median portion 234 about a receiving opening 240 thereof. The bracket 238 includes an opening 242 for mounting the connector 230 therethough. In this way, as shown in FIG. 14, the stacked dispenser rows 12 are positioned at an incline relative to base 206 of the frame 214 and are sufficiently spaced apart allowing for the doors 220 which are pivotally mounted to the frame 214 at each longitudinal end thereof to have sufficient clearance when opening so that a lower door does not hinder opening of the next upper door 220. Connecting each dispenser 202 separately to the backing panel 208 provides for removing each dispenser 202 separately from the assembly 200.

Figure 22:
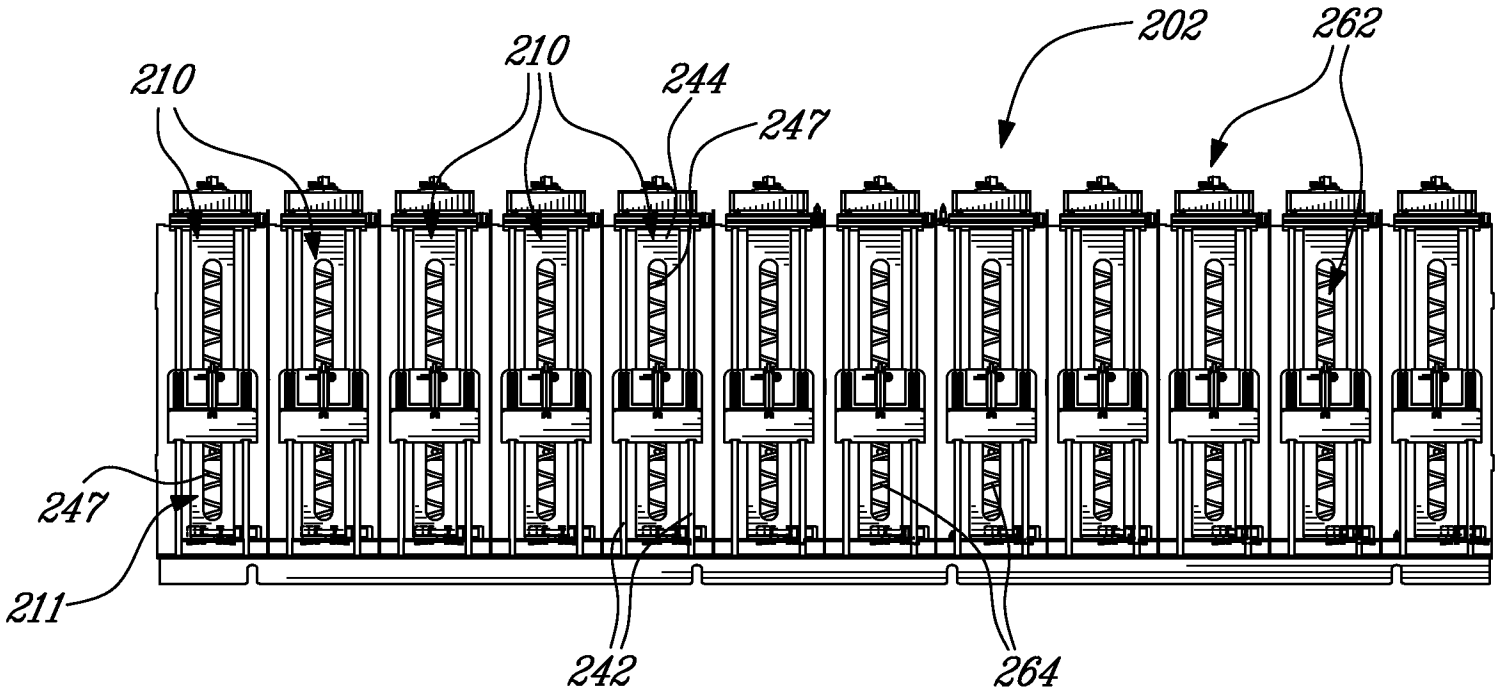
FIG. 22 is another top plan view of a dispenser row of the dispenser assembly of FIG. 13.
Figure 23:
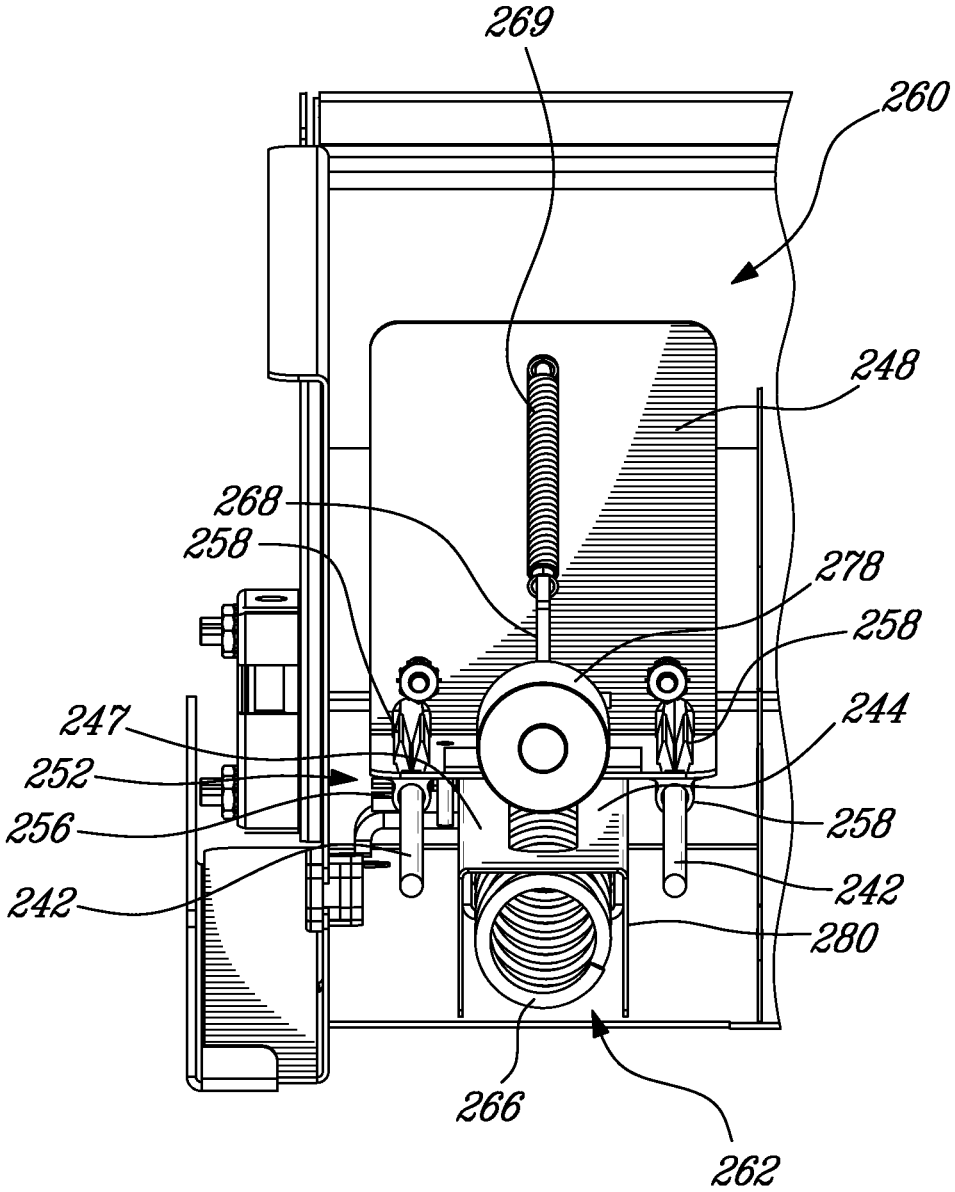
FIG. 23 is a rear view of a pusher assembly in accordance with another illustrative embodiment.

As better shown in FIGS. 22 and 23, each dispenser compartment 210 receives a horizontal stack of packets P that are positioned on supports in the form of guide rods 242 as well as a floor 244 provided by an channel member 246 having an slot 247.

Figure 15:
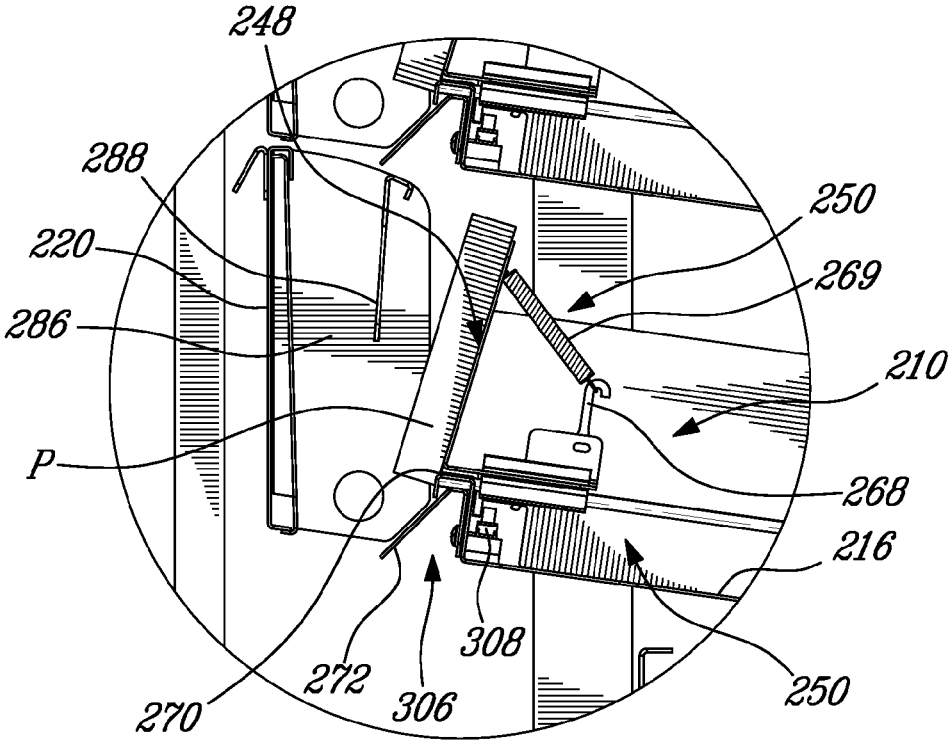
FIG. 15 is an enlarged view of portion 15-15 of FIG. 14.

The inclination of each dispenser 202 provides a slant which causes the packets P to rest on a back supporting element 248 which is also slanted as shown in FIGS. 14 and 15. The back support element 248 is part of a pushing member 250 which includes a base 252 that is slidably mounted to guide rods 242 via tubes 256 (see FIG. 21 and which include upper tabs 250 that can be pinched when opening the tubes 256 during mounting or removal of the base 252; the foregoing forming part of a movement imparting assembly or a pusher assembly 260.

Figure 18:
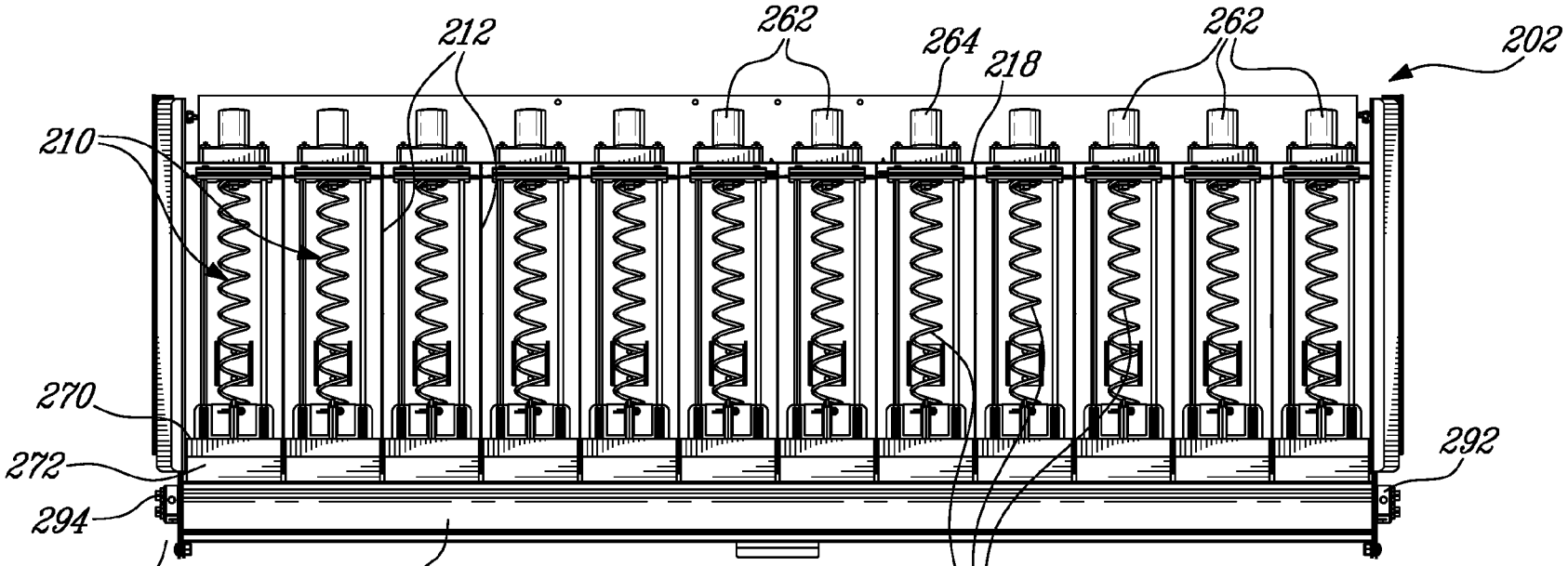
FIG. 18 is a top plan view of a dispenser row of the dispenser assembly of FIG. 13.

Each compartment 210 includes a pusher assembly 260 having an actuator as shown in FIGS. 18, 22 and 23 including a motor 264, mounted to the backing wall 218 of the dispenser 202 to for actuating a movement imparting element 264 in the form of a helicoidal member (see in particular FIGS. 18, 22 and 23).

Figure 21:
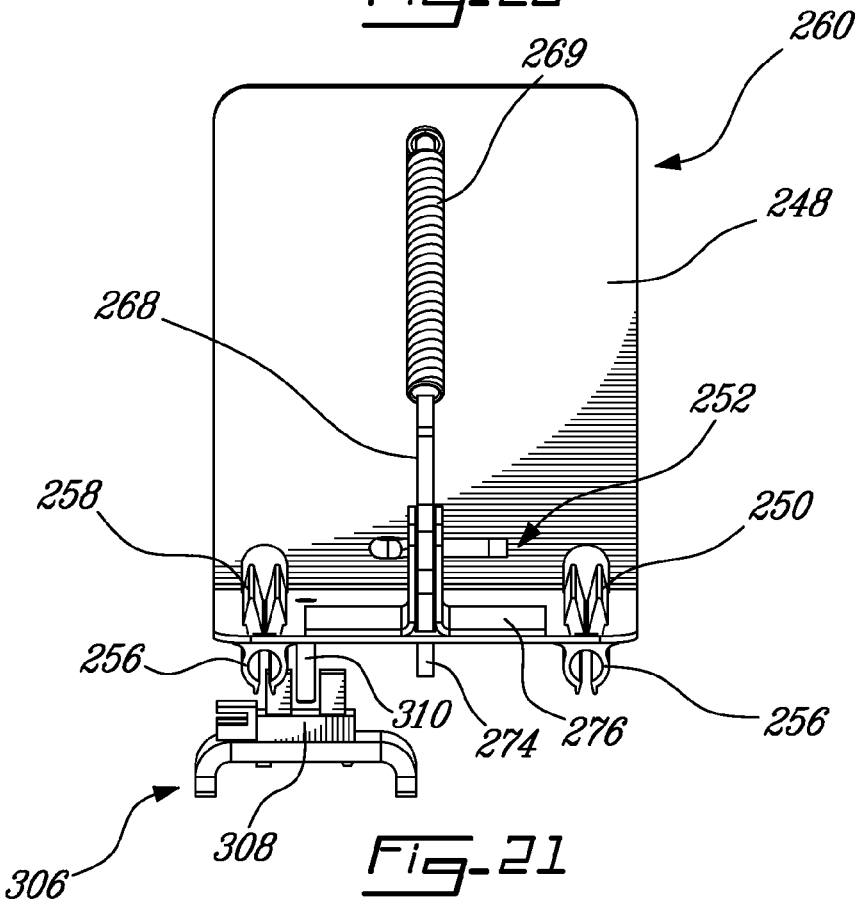
FIG. 21 is a rear view of a pusher assembly in accordance with an illustrative embodiment.

The helicoidal member 264 turns about a central axis and abuts a pin 268 mounted to the rear side of the push member 248 via a spring 269 (see FIGS. 15, 21 and 23) mounted to the base 252 causing the pushing member 248 to slide along the guide rods thereby pushing the packets P off the edge 270 of the compartment 210 to slide along a chute 272 that extends from this front edge 270. FIG. 21 shows that the pin 268 includes a bottom end 274 protruding through a slot 276 of the base 252 for being engaged by the helicoidal member 264. FIG. 23 shows that the pin member 268 includes a bottom tubular rack member 278 to be engaged by the helicoidal member 264 similarly to a pinion.

As better shown in FIGS. 22 and 23, the bottom floor 244 is provided by an inverted U-shaped channel structure covering the helicoidal member and providing it to engage the pin 268 via the slot 247.

FIG. 14, shows that the vertical series of elongated doors 220 are spaced from the vertically stacked dispensers 202 providing a pathway 282 leading to a bottom receptacle 284 for retrieving fallen packets P. As shown in FIG. 15, each door 220 includes a side panel 286 with an elongated chute 288 beneath chute 272 (when the door is in the closed position) for guiding the falling packet P within the pathway 282.

With respect to FIGS. 13, 18, 19 and 20 sensor 290 including an emitter 292 and a receptor 294 providing an infrared beam 296 therebetween through holes (not shown) in the side supports 298 to which the doors 220 are pivotally mounted to via pivots 300 and through holes 302 formed in the side panels 286 of the doors 220. The beam is provided within the space defined by the spaced apart door 220 and compartment front edge 270 which forms part of the pathway 282. When a packet falls within the pathway 282, the beam 296 is interrupted and the sensor 290 sends a signal to the motor 264 to stop actuating the helicoidal member 264. When the door 220 is opened a rear blocker 304 is interposed between the emitter 292 and the receptor 296 thereby interrupting the beam 296 and preventing the motor 264 from operating.

With reference to FIGS. 15 and 21, there is provided a sensor assembly such as an actuator deactivation assembly 306. The assembly 306 includes a sensor 308 mounted within the compartment 210 on the floor 216 near the front edge 270. In this example, the sensor 308 comprises an optical gate. An emitter 310 protrudes downwardly from the base 252. When the last packet P is pushed off the edge 270, the emitter 310 mates with the optical gate 308 sending a message to the controller 312 (see FIG. 13) that a certain compartment 210 of a certain dispenser row 202 is empty.

In fact, the controller 310 is in communication with the sensor 290 as well. It therefore, can receive information regarding the number of packets P that have been dispensed from each compartment 210 in each dispenser row 202 and by the same token the amount of packets P that are left in each compartment 210 of each dispenser row 202. The type of packet P that have been stacked in each compartment 210 of each dispenser row 202 can also be tracked as the user can enter this information via the controller 310 keypad.

The worker can enter an identification code via the controller 310 keypad, all the packets P that are sold during the worker's shift are attributed to this worker. Once the worker logs off, a print out is provided showing the types and number of packets that were dispensed.

Figure 24:
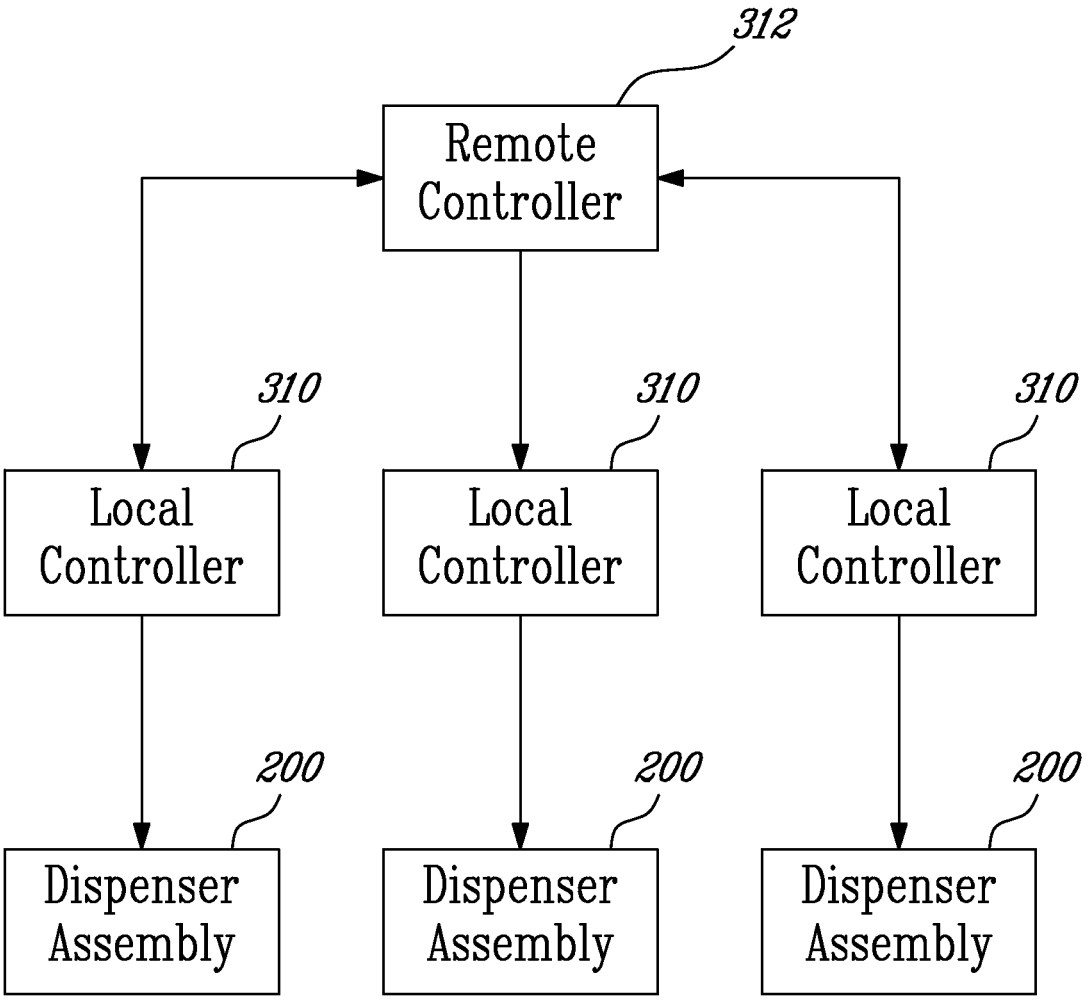
FIG. 24 is a block diagram of a system for monitoring the inventory of packets that are dispensed at a plurality of locations in accordance with an illustrative embodiment.

FIG. 24 shows a system for monitoring the inventory of packets that are to be dispensed in a variety of locations such as stores. A remote controller 312 at a central station is in communication with the local controllers 310 linked to respective dispenser assemblies 200 at various locations. The remote controller 312 of the central station can monitor the amount and types of packs that are dispensed or left in each compartment 210 of each dispenser row 220 for each assembly 200. In this way, the dispensing frequency of various types of packets can be evaluated. The need for the central station to supply a certain location with a certain amount and types of packets P can also be anticipated based on the information received from the local controllers 310.

Figure 25:
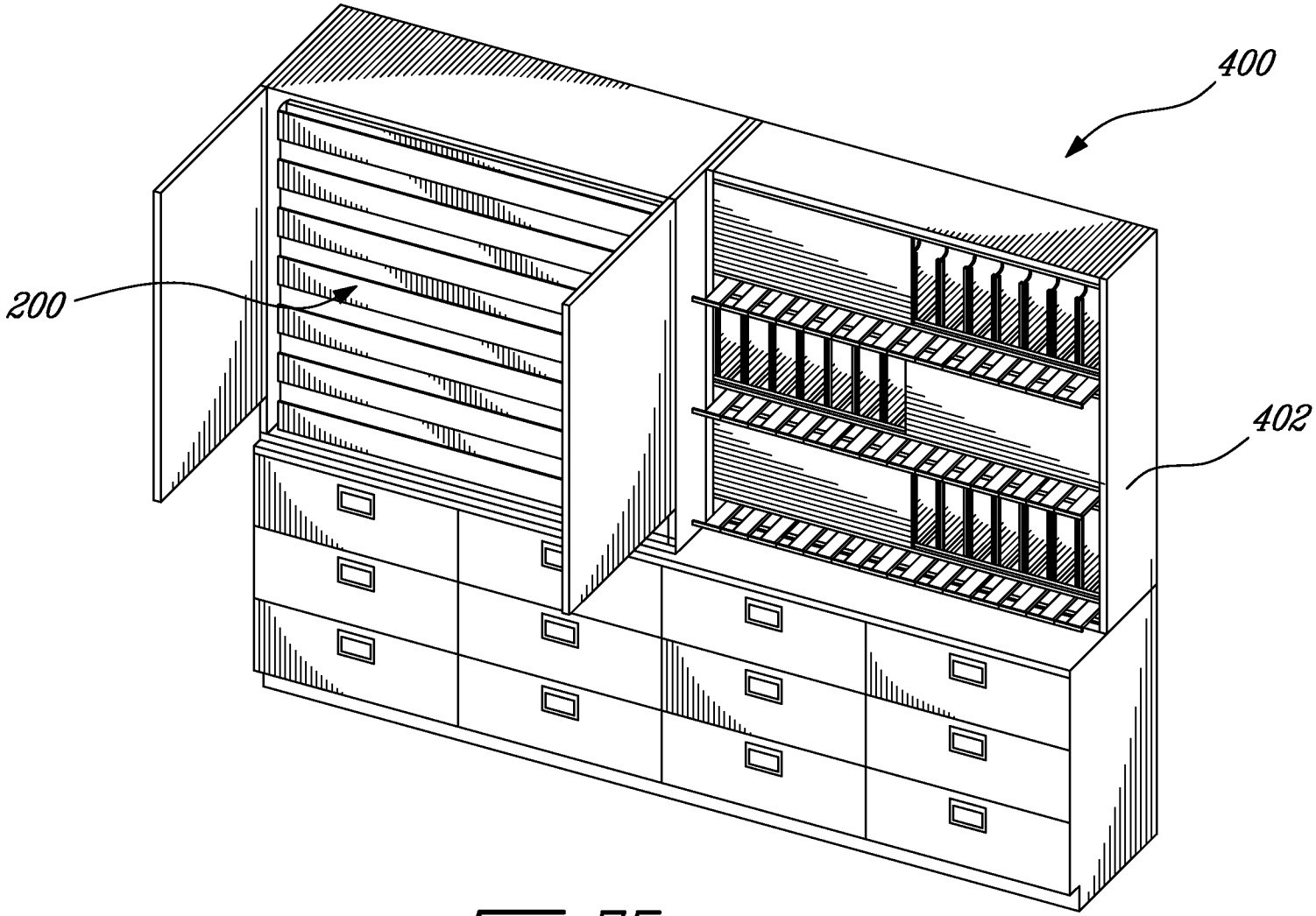
FIG. 25 is perspective view of a cabinet assembly comprising a dispenser assembly in accordance with an illustrative embodiment.

FIG. 25 shows a cabinet assembly 400 comprising a cabinet structure 402 including a dispenser assembly 200.

The various features described hereinabove can be combined in a variety of suitable ways, as the skilled artisan will readily appreciate, so as to provide further embodiments within the scope of the present invention. Furthermore, it is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention.

What is claimed is:

1. A dispenser for packets comprising:

at least one compartment defining a channel for receiving a horizontal stack of packets, said compartment comprising a front edge;

a support mounted within said compartment for the horizontal stack of packets comprising a central slot and forming to surfaces at each side of said central slot for supporting thereon the horizontal stack of packets; and a movement imparting assembly mounted within said compartment and comprising:

a pusher member for engaging the horizontal stack of packets, said pusher member comprising a backing support upwardly extending from a base slidably mounted to said support top surfaces and having a pin pivotally mounted thereto and extending into said slot;

a helically wound member positioned beneath said support and extending along the length of said slot;

an actuator for actuating said helically wound member so as to rotate about its axis thereby providing for engaging said pin and causing said pusher member to move forward within said channel;

wherein said movement imparting assembly provides for said pusher member to selectively push forward the horizontal stack of packets so as to push at least one of the packets in said compartment off the edge thereof for retrieval.

2. A dispenser according to claim 1, further comprising a plurality of side by side said compartments, each compartment defining a channel receiving a respective horizontal stack of packets, each said compartment comprising a front edge, a said movement imparting assembly respectively mounted within each said compartment and respectively comprising a pusher member for engaging the respective horizontal stack of packets.

3. A dispenser according to claim 1, further comprising a door positioned in front of said compartment and forwardly spaced from said front edge.

4. A dispenser according to claim 3, wherein the packet is provided to fall between said door and said front edge when pushed forwardly.

5. A dispenser according to claim 1, wherein said channel is rearwardly slanted relative to said front edge.

6. A dispenser according to claim 1, further comprising a sensor for detecting that at least one packet has fallen off said front edge.

7. A dispenser according to claim 6, wherein said sensor is in communication with a controller.

8. A dispenser according to claim 6, wherein said sensor is in communication with said movement imparting assembly for signalling said movement imparting assembly to cease pushing the horizontal stack of packets forward when the at least one packet falls off said front edge.

9. A dispenser according to claim 1, further comprising a sensor assembly for detecting when the last packet of the horizontal stack of packets has been pushed off said front edge.

10. A dispenser according to claim 9, wherein said pusher member comprises an emitter, said compartment comprising a sensor mounted near said front edge, wherein when said emitter mates with said sensor thereby providing a signal.

11. A dispenser according to claim 10, wherein said signal is communicated to a controller.

12. A dispenser according to claim 10, wherein said signal is communicated to said movement imparting device for deactivation thereof.

13. A dispenser according to claim 1, wherein said compartment is removably mountable to a frame.

14. A dispenser according to claim 13, wherein said compartment comprises a rear wall with a connector to be connected to a corresponding connector mounted to said frame.

15. A dispenser assembly comprising a plurality of dispensers, wherein at least one dispenser comprises the dispenser of claim 1.

16. A system for monitoring the inventory of packets that are dispensed at a plurality of locations comprising:

a plurality of the dispensers of claim 1 containing an initial known number of packets, each said dispenser being located at a respective location;

a plurality of sensors, each said sensor mounted to a respective said dispenser for detecting dispensing of a packet;

a plurality of local controllers, each said local controller in communication with a respective said sensor so as to be notified when a packet is dispensed by a said dispenser at a given location;

a remote controller having information regarding the initial known number of packets in each dispenser and being linked to each said local controller so as to be notified when a packet of a given said dispenser at a given location is dispensed.

17. A dispenser assembly for packets comprising:

a plurality of vertically stacked dispenser rows comprising a plurality of side by side compartments, each said compartment defining a respective channel for receiving a horizontal stack of packets and comprising a front edge;

a respective support mounted within each said compartment for the horizontal stack of packets comprising a central slot and forming top surfaces at each side of said central slot for supporting thereon the horizontal stack of packets; and a respective movement imparting assembly mounted within each said compartment and comprising:

a pusher member for engaging the horizontal stack of packets within said channel, said pusher member comprising a backing support upwardly extending from a base slidably mounted to said support top surfaces and having a pin pivotally mounted thereto and extending into said slot;

a helically wound member positioned beneath said support and extending along the length of said slot;

an actuator for actuating said helically wound member so as to rotate about its axis thereby providing for engaging said pin and causing said pusher member to move forward within said channel;

wherein each said movement imparting assembly provides for said pusher member to selectively push forward a respective horizontal stack of packets so as to push at least one of the packets of a given stack in a given said compartment off the edge thereof for retrieval.

* * * * *